US006957914B2

(12) United States Patent
Arends et al.

(10) Patent No.: US 6,957,914 B2
(45) Date of Patent: Oct. 25, 2005

(54) POUCH MULTIPACKAGE

(75) Inventors: Craig W. Arends, Elgin, IL (US); Leslie S. Marco, Bloomingdale, IL (US); John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 336 days.

(21) Appl. No.: 10/167,680

(22) Filed: Jun. 12, 2002

(65) Prior Publication Data

US 2004/0195143 A1 Oct. 7, 2004

(51) Int. Cl.[7] ..... B65D 30/00

(52) U.S. Cl. ..... 383/37; 383/61.1; 383/64; 383/204

(58) Field of Search ..... 383/37–38, 61.1, 383/63–64, 203–204; 206/554, 466

(56) References Cited

U.S. PATENT DOCUMENTS

| | | | | | |
|---|---|---|---|---|---|
| 1,246,530 | A | | 11/1917 | Bird | |
| 2,050,967 | A | | 8/1936 | Farmer | |
| 2,122,025 | A | | 6/1938 | Crary | |
| 2,272,623 | A | * | 2/1942 | Runner | 206/466 |
| 2,479,700 | A | * | 8/1949 | Pritchard | 383/23 |
| 2,722,368 | A | | 11/1955 | Gottsegen | |
| 2,833,402 | A | * | 5/1958 | Lefebvre | 206/466 |
| 3,029,939 | A | * | 4/1962 | Feldman | 206/466 |
| 3,099,352 | A | * | 7/1963 | Aven | 206/466 |
| 3,172,443 | A | | 3/1965 | Ausnit | |
| 3,226,787 | A | | 1/1966 | Ausnit | |
| 3,318,444 | A | * | 5/1967 | Weicher | 206/493 |
| 3,323,707 | A | | 6/1967 | King | |
| 3,339,824 | A | * | 9/1967 | Luke | 383/25 |
| 3,370,630 | A | | 2/1968 | Haugh et al. | |
| 3,452,922 | A | | 7/1969 | Hart | |
| 3,462,069 | A | | 8/1969 | Suominen | |
| 3,608,439 | A | | 9/1971 | Ausnit | |
| 3,679,511 | A | | 7/1972 | Ausnit | |
| 3,685,562 | A | | 8/1972 | Ausnit | |
| 3,877,352 | A | | 4/1975 | Brieske | |
| D242,900 | S | * | 1/1977 | Seiferth et al. | D9/732 |
| 4,040,562 | A | | 8/1977 | Ward et al. | |
| 4,112,541 | A | | 9/1978 | Tetradis | |
| 4,119,268 | A | | 10/1978 | Segura | |
| 4,148,431 | A | | 4/1979 | Lepisto | |
| 4,241,865 | A | | 12/1980 | Ferrell | |
| 4,696,050 | A | | 9/1987 | Sengewald | |
| 4,827,114 | A | | 5/1989 | Blachon | |
| 4,827,566 | A | | 5/1989 | Richins | |
| 4,832,505 | A | | 5/1989 | Ausnit et al. | |
| 4,871,264 | A | | 10/1989 | Robbins, III et al. | |
| 4,877,337 | A | | 10/1989 | Wood | |
| 4,923,309 | A | | 5/1990 | VanErden | |
| 4,927,271 | A | | 5/1990 | Branson | |
| 4,941,196 | A | | 7/1990 | Edelman et al. | |
| 4,953,708 | A | | 9/1990 | Beer et al. | |
| 4,989,993 | A | | 2/1991 | Barnard | |
| 5,033,868 | A | | 7/1991 | Peppiatt | |
| 5,059,033 | A | | 10/1991 | Branson | |
| 6,347,885 | B1 | | 2/2002 | Buchman | |

(Continued)

OTHER PUBLICATIONS

Packaging Strategies Publications–Stand Up Pouches Brochure (Relevant portions) By Allied Development Corporation, No Date.

*Primary Examiner*—Jes F. Pascua
(74) *Attorney, Agent, or Firm*—Pauley Petersen & Erickson; Mark W. Croll; Jay A. Saltzman

(57) ABSTRACT

A package for unitizing at least two pouches includes a flexible multipack header positioned between the pouches and adhered along a top portion of the pouches. Each pouch is removable along a tear line to expose a slider, a zipper and/or a secondary tear line to access the pouch or a tamper evident seal.

12 Claims, 4 Drawing Sheets

U.S. PATENT DOCUMENTS 5,080,497 A 1/1992 Peppiatt
5,088,667 A 2/1992 Olson
5,145,258 A 9/1992 Schneck et al.
5,174,657 A 12/1992 Peppiatt
5,181,757 A 1/1993 Montoya
D340,863 S 11/1993 Daigle
5,290,104 A 3/1994 Sengewald
5,407,277 A 4/1995 Burke et al.
5,492,411 A 2/1996 May
5,601,368 A 2/1997 Bodolay et al.
5,651,575 A 7/1997 Bystrom et al.
D384,273 S 9/1997 Willils
5,669,715 A 9/1997 Dobreski et al.
5,782,562 A 7/1998 Anspacher
5,785,804 A 7/1998 Kovacs
5,788,080 A * 8/1998 Sill et al. ..... 206/554
5,921,601 A 7/1999 Buckles
6,053,635 A 4/2000 Anderson
D430,490 S 9/2000 DuCorday
6,116,424 A * 9/2000 Leu ..... 206/554
6,153,232 A 11/2000 Holten et al.
6,257,763 B1 7/2001 Stolmeier
6,273,607 B1 8/2001 Buchman
6,290,390 B1 9/2001 Buchman
6,290,391 B1 9/2001 Buchman

* cited by examiner

POUCH MULTIPACKAGE

BACKGROUND OF THE INVENTION

1. Field of the Invention

This invention relates to a multipackage having at least two removable pouches attached to a multipack header along a tear line.

2. Description of Prior Art

Pouches are commonly used to package and market products such as noodles, juice, coffee and pet food. Such pouches are generally constructed of moisture resistant, flexible material and often are displayed to consumers in bins, shelves or hung on peg hooks. Pouches of this sort are generally sold individually or in multipackages unitized in paperboard or cardboard tertiary boxes. Individual pouches are often difficult to display and manage and existing pouch multipackages often do not give the consumer direct visual feedback of what is bundled within the box.

One solution in the prior art to bundling multiple packages has been a double pouch or "saddle bag" wherein two pouches are sealed to each other across one edge for subsequent sale. Such double pouches increase the volume of product sold but are typically limited to only two pouches per package and generally result in awkward display and carrying.

Therefore, there exists a need for a unitized multipackage of conventional pouches that presents the pouch in an appealing manner, is convenient to manage, display and carry and is efficient to produce and discard. In addition, there exists a need to remove the pouches from the multipackage in a manner that does not damage the integrity of the respective pouch or the remaining pouches in the multipackage and still permits resealable access to the detached pouch.

SUMMARY OF THE INVENTION

It is one object of this invention to unitize two or more individual pouches into an efficient multipackage that is easily displayed, carried and disassembled.

It is another object of this invention to unitize two or more individual pouches in a multipackage that permits removal of each individual pouch.

It is another object of this invention to unitize two or more individual pouches in a multipackage that still permits resealability and/or tamper evidence following removal of each individual pouch.

It is another object of this invention to stabilize an inherently unstable group of individual pouches using a multipack header adhered to a top portion of each individual pouch.

It is another object of this invention to create promotional area within a group of individual pouches using a multipack header.

A "package" according to this invention preferably includes at least two pouches and a multipack header positioned and adhered along a top portion of the pouches. The multipack header is formed from a generally planar and flexible sheet of low density polyethylene and is punched into a preferred configuration, such as described below. Particularly, the multipack header may be formed to include a gripping aperture and one or more generally planar attachment areas.

According to one preferred embodiment of the multipack header and package, a single planar sheet of plastic forms the multipack header and includes the gripping aperture positioned along a top portion of the multipack header and attachment areas extending along each side of a lower portion of the multipack header. The pouches are then adhered to each side of the multipack header along an outer surface and/or inner surface.

Each pouch is removably attached, either separately or in predetermined groups, along a tear line to permit separation of each respective pouch. The tear line preferably comprises a tearable, separable weakness in the package such as a perforation, a heat seal, a slice in the edge of the pouch and/or multipack material to permit the consumer to clearly comprehend where to separate each pouch and then easily accomplish separation of each pouch from the remainder of the package.

According to one preferred embodiment of this invention, each pouch includes a closure to permit resealeable access to the pouch. The closure preferably becomes accessible upon detachment of the pouch from along the tear line and may comprise a zipper, a slider and/or any similar such closure that permits resealability of the pouch.

Each pouch may additionally include a secondary tear line which remains integral with the pouch upon detachment of the pouch along the primary tear line. This secondary tear line permits the pouch to be detached from the package and still retain a tamper evident seal and/or an additional tear line that retains the integrity of the separated pouch. The secondary tear line can be either outboard or inboard of a closure when the pouch is removed from the multipack and can be opened to expose either the contents of pouch or a closure such as described above.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
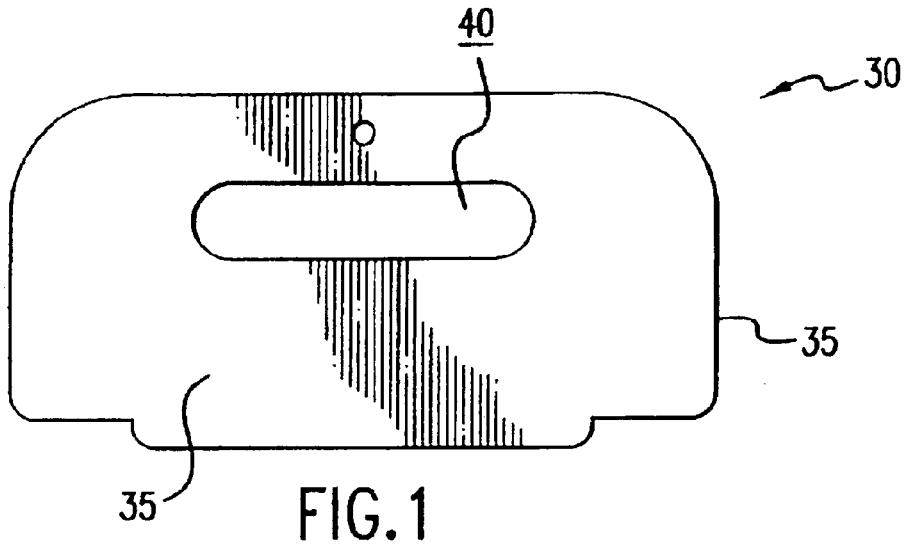
FIG. 1 is a front view of a multipack header according to one preferred embodiment of this invention.

FIGS. 1–12 show several preferred embodiments of multipack header 30 and unitized package 10 of two or more pouches 20. According to a preferred embodiment of this invention, a "pouch" may comprise polyester, metallized PET, mylar, foil, paper or other non-rigid container for holding food product, liquids, powders, pellets, aggregrate and/or other goods that may be packaged in a disposable, flexible container. Although pouches are the preferred package described in this invention, bags and other suitable containers may also be unitized using the invention described herein.

A pouch typically includes laminates with a high temperature, non-sealable film composing an outer layer and a sealable film composing the inner layer. The pouch typically includes a bottom, which may provide a self-supporting base, and two generally parallel sides extending and/or tapering towards a top. According to one preferred style of pouch, called a "gusseted pouch," a self-supporting, generally planar base is created using a gusseted bottom. In addition, such a pouch may include a gusseted top. According to another preferred style of pouch, called a "pillow pouch," a bottom of the pouch is sealed so as to not result in a self-supporting base. Such pouches may have various configurations including different shapes, sizes, spouts and/or closures.

Regardless of the preferred configuration of the pouch, the two generally parallel and/or tapering sides, or sidewalls, terminate at a top of the pouch which is formed, in part, by an internal seal between the two sides. The internal seal preferably is formed between the inner walls of the two opposing sides of the pouch. This internal seal holds and maintains the respective contents within the pouch until the consumer tears or otherwise breaks the seal to access the inside contents of the pouch. This internal seal, called a "fin seal," creates a generally planar area along the top of the pouch generally along and above the internal seal area.

Examples of such products distributed in pouches include juice, coffee, pet food, pet treats, fertilizer, cheese, cold cuts, dry pasta, baking mixes, etc. Accordingly, package 10 according to this invention, may hold any number of pouches 20 that are convenient for cost, weight and/or consumption. Often, such products require a closure, preferably resealable, for at least opening and in many cases reclosing and resealing the package following removal of at least a portion of the product. An example of such a closure is a zipper wherein a male track and a female track are embedded along opposite sides of the opening of the pouch and both separable to open the pouch and mateable to seal the pouch. A similar such closure may further include a slider wherein an apparatus is slideably positioned along the male or female track and may be grasped and moved across the zipper to provide mechanical assistance to either seal and close or separate and open the pouch.

In addition, such products often require tamper evident packaging or similar indicia to show that a pouch has previously been opened and/or otherwise tampered with. Such tamper evident packaging may include a strip of material or seal across a openable end of pouch to indicate that the contents of a particular pouch are in pristine condition, free of contaminants as such contents left the packaging facility.

Figure 2:
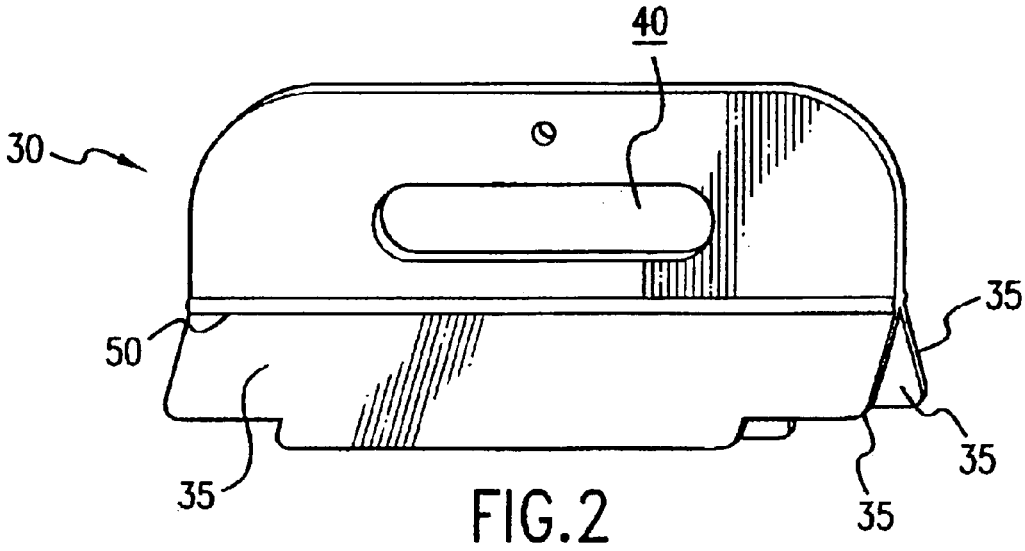
FIG. 2 is a front view of a multipack header according to one preferred embodiment of this invention.
Figure 3:
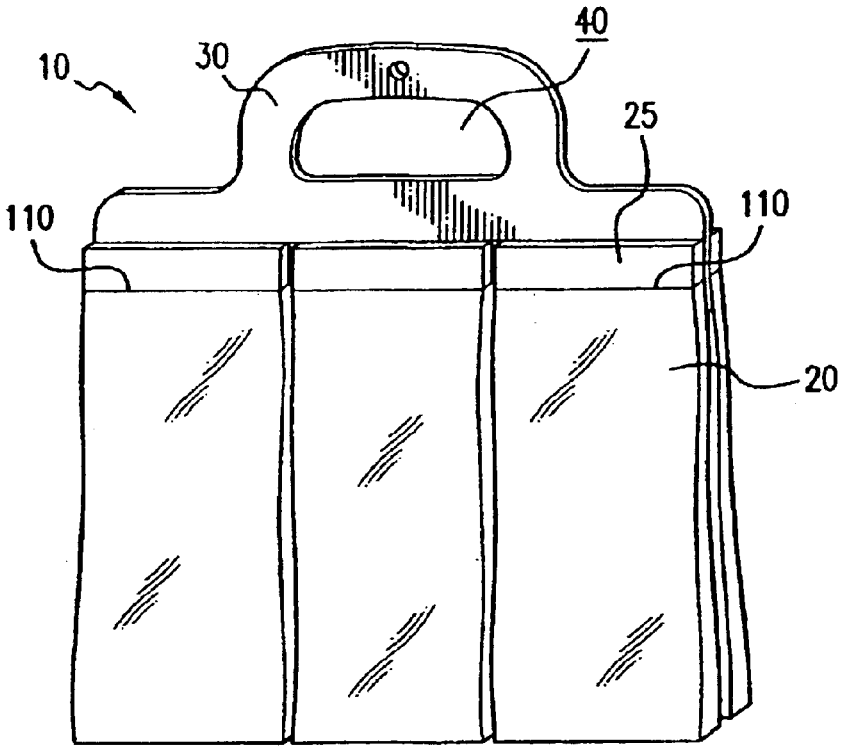
FIG. 3 is a front perspective view of a package according to one preferred embodiment of this invention.

Package 10 according to a preferred embodiment of this invention is shown in FIG. 3 and preferably includes at least two pouches 20 and multipack header 30 positioned and adhered along top portion 25 of the pouches 20. FIG. 3 shows an arrangement including six pouches 20. Multipack header 30 according to a preferred embodiment of this invention is formed from a generally planar, flexible sheet of low density polyethylene and die-cut, or otherwise formed, into a preferred configuration, such as shown in FIGS. 1 and 2.

Pouches 20 are preferably formed in an array within package 10. According to one preferred embodiment of this invention, pouches 20 may be formed in an array of longitudinal rows and transverse ranks. The longitudinal rows of pouches 20 are preferably formed along the length or long edge of multipack header 30. Transverse ranks of pouches 20 may be formed by positioning pouches on either side of multipack header 30, possibly in multiple layers as described in more detail below.

As a result of the various configurations of packages 10 described herein, two or more inherently unstable pouches 20 may be joined using multipack header 30 to create a stable package 10. A unitized package 10 having such stability may be stacked, hung, displayed, stored and carried in a more efficient manner than conventional groups of such individual pouches 20.

Multipack header 30 preferably formed or punched to include gripping aperture 40 and one or more generally planar attachment areas 35. Gripping aperture 40 is preferably spaced to receive at least a portion of one or more fingers or a hand of a consumer to result in a comfortable carrying engagement. Alternatively, or in addition, multipack header 30 may include one or more smaller apertures to facilitate hanging multipack header 30 from a peg hook or similar hanging display.

Attachment areas 35 are preferably sized and positioned to facilitate attachment of two or more pouches 20, in particular, along the top edges of each of the two parallel sides of pouch 20, namely along the generally planar area surrounding a fin seal. Attachment areas 35 are generally planar and of sufficient length to glue, beat seal or otherwise affix a portion of pouch 20 to multipack header 30 in a manner to prevent accidental detachment and yet permit purposeful detachment, preferably without diminishing the integrity of the remaining package.

Figure 4:
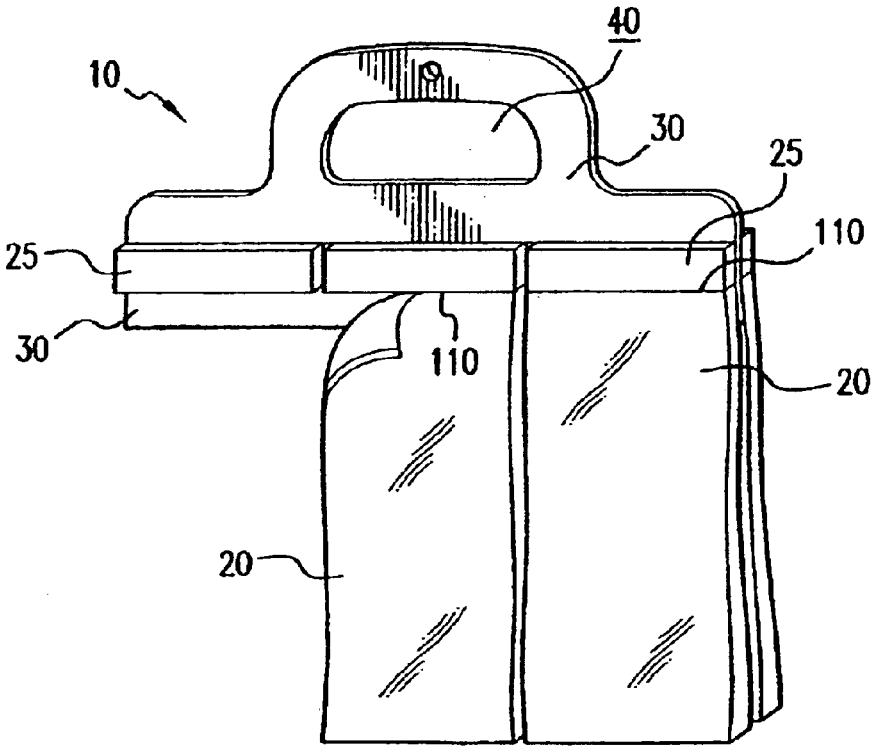
FIG. 4 is a front perspective view of a partial package, similar to that shown in FIG. 3, following removal of two pouches and initiation of removal of a third pouch.

According to one preferred embodiment of multipack header 30 and package 10 shown in FIGS. 1, 3 and 4, multipack header 30 comprises a single planar sheet of plastic having gripping aperture 40 positioned along top portion 25 of multipack header 30 and attachment areas 35 extending along each side of a lower portion of multipack header 30. Pouches 20 are then adhered to each side of multipack header 30 along each attachment area 35. As shown in FIGS. 3–6, package 10 may be configured so that each attachment area 35 is positioned along outer surfaces of multipack header 30 so that pouches 20 are affixed along the outside of package 10. Therefore, multipack header 30 is positioned along the interior of package 10 and may be generally hidden from view but for top portion 25 having promotional billboard area and/or gripping aperture 40.

Figure 8:
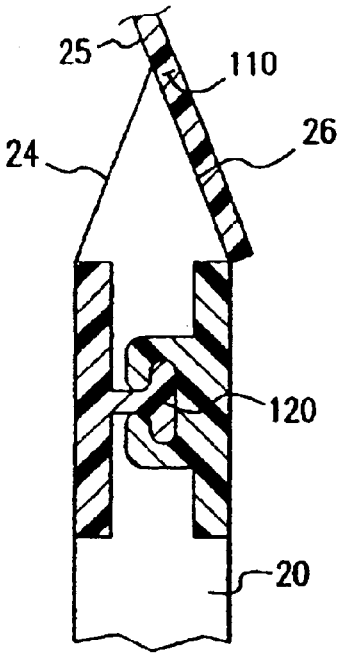
FIG. 8 is an enlarged side cross-sectional view of Detail 8 shown in FIG. 7.
Figure 7:
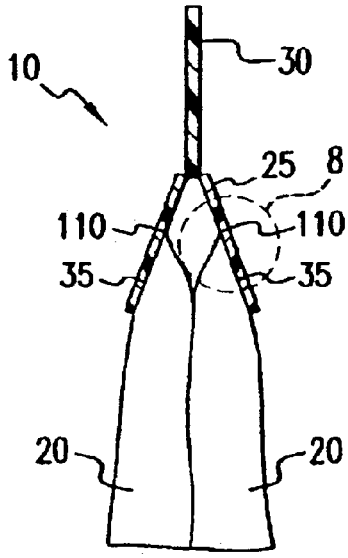
FIG. 7 is a side view of a package using a multipack header similar to that shown in FIG. 2.

Other preferred embodiments of package 10 and multipack header 30 are shown in a copending U.S. patent application Ser. No. 10/167,916, titled Pouch Multipackage, filed on an even date herewith, and incorporated herein by reference. According to one such preferred embodiment of this invention, such as shown in FIGS. 2, 7 and 8, multipack header 30 comprises two generally planar attachment areas 35 extending in different planes from top portion 25 of multipack header 30, wherein at least one pouch 20 is attached to each attachment area 35. According to package 10 shown in FIGS. 7 and 8, individual pouches 20 may be positioned on the inside surfaces of multipack header 30 to expose more surface area of multipack header 30 and less of top portion 25 of each pouch 20.

According to a preferred embodiment of this invention, pouches 20 may be pillow-pouches or other pouches that do not include a self-supporting base. In addition, gusseted pouches may include contents, such as liquid, that result in an inherently unstable pouch or package. Accordingly, multipack header 30 provides a longitudinal rigidity along the top portion of package 10 thereby creating a generally stable package 10 from otherwise unstable pouches 20. As a result, opposing pouches 20 connected along their respective top portions form a self-supporting "saw horse" structure having a central connection point at multipack header 30. Opposing pouches 20 thereby lean against each other based upon a fixed connection point along the pouches 20 respective top portions.

As described above, the unitized package 10 according to this invention includes two or more pouches 20 affixed to multipack header 30, specifically attachment areas 35 of multipack header 30. Pouches 20 may be affixed or adhered to multipack header 30 in any number of methods. Pouches 20 may be heat sealed to multipack header 30, glued directly to multipack header 30, taped to multipack header 30 or otherwise adhered to multipack header 30 using methods known to those having ordinary skill in the art. Preferably, each pouch 20 is separately removable from multipack header 30 so that the integrity of package 10 remains intact following removal of one or more pouches 20.

In one embodiment each pouch 20 may be removed by overcoming the adhesion between multipack header 30 and pouch 20. As shown in FIGS. 3 and 4, according to another preferred embodiment of this invention, each pouch 20 is removably attached, either separately or in predetermined groups, along tear line 110, also referred to as a primary tear line, to disengage each respective pouch 20. Tear line 110 may be integrated with each respective pouch 20, integrated within multipack header 30 or positioned between each pouch 20 and multipack header 30. Tear line 110 preferably comprises a tearable, separable weakness in package 10 such as a perforation, a heat seal, a slice in the edge of the pouch and/or multipack material, and/or any other similar embedded weakness. Regardless of the particular embodiment, the object of tear line 110 is to permit the consumer to clearly comprehend where to separate each pouch 20 and then easily accomplish separation of each pouch 20 from the remainder of package 10.

In one embodiment, tear line 110 extends through both sides 24, 26 of pouch 20. The top of pouch 20 can either be folded over, glued or otherwise sealed along the top. As a result, when pouch 20 is removed from multipack header 30, the upper portion 25 and sides 24, 26 of pouch 20 are separated along tear line 110 and thus pouch 20 is accessible to either its contents, a resealable closure 120 or to another tamper evident seal, such as the secondary tear line discussed below. FIGS. 5–12 show various preferred embodiments of pouch 20 relative to multipack header 35 and various subsequent ways of access to the contents of pouch 20.

Figure 5:
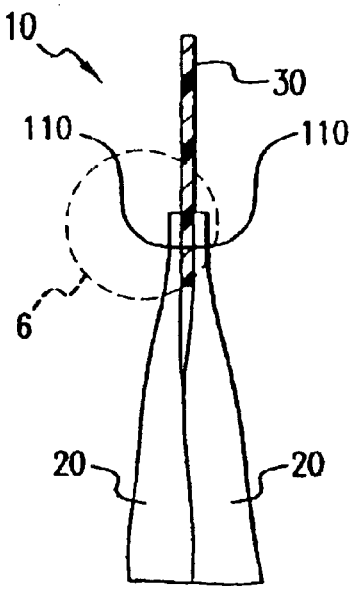
FIG. 5 is a side view of a package using a multipack header similar to that shown in FIG. 1.
Figure 6:
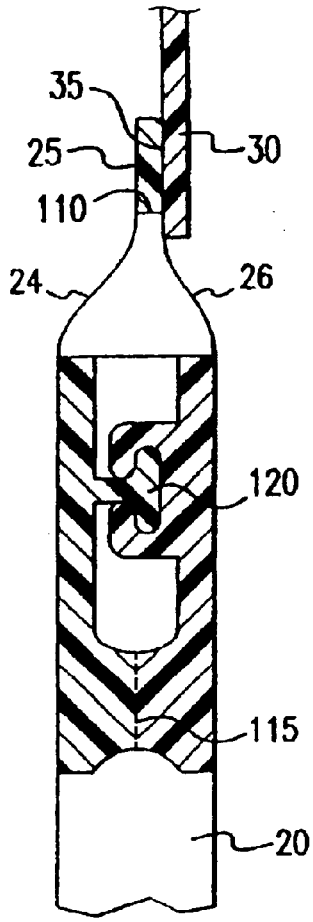
FIG. 6 is an enlarged side cross-sectional view of Detail 6 shown in FIG. 5.

Tear line 110 is preferably positioned between top portion 25 of each pouch 20 and a remaining portion of each pouch 20 so that each pouch 20 is separately removable from the multipack header 30 along tear line 110. Alternatively, a single tear line 110 may permit the removal of all pouches 20 simultaneously from multipack header 30. FIGS. 5 and 6 shows package 10 wherein tear lines 110 are positioned along each pouch 20 to permit removal of such pouch 20. FIGS. 7 and 8 shows package 10 wherein tear lines 110 are positioned along multipack header 30 to permit removal of each pouch 20.

Figure 9:
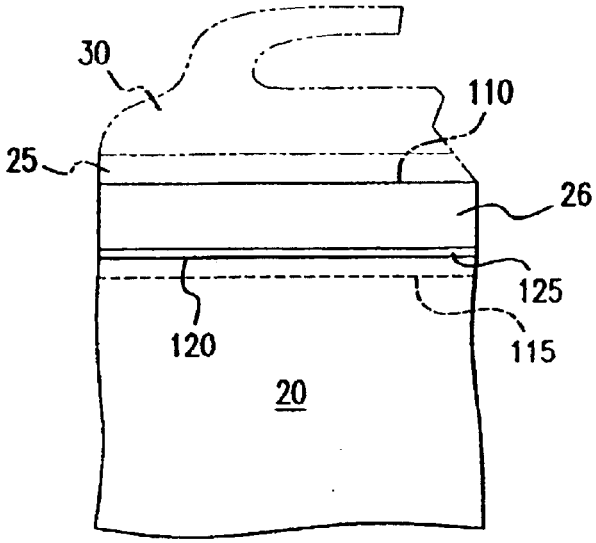
FIG. 9 is a front view of a pouch following removal from a package according to one preferred embodiment of this invention.
Figure 10:
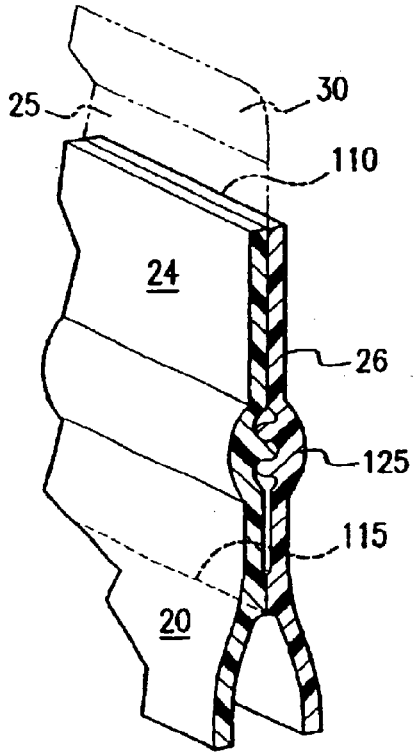
FIG. 10 is a side cross-sectional view of the pouch similar to that shown in FIG. 9.
Figure 11:
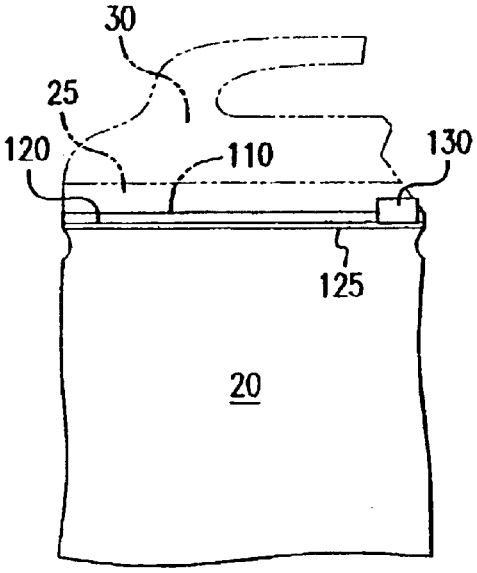
FIG. 11 is a front view of a pouch following removal from a package according to another preferred embodiment of this invention.
Figure 12:
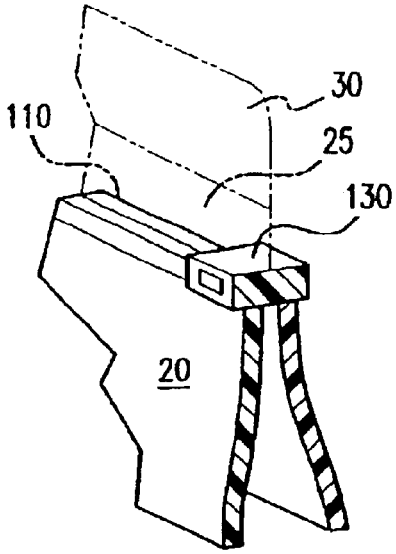
FIG. 12 is a side cross-sectional view of the pouch similar to that shown in FIG. 11.

According to one preferred embodiment of this invention, pouch 20 further includes closure 120 to permit resealeable access to pouch 20. In one embodiment, closure 120 preferably becomes accessible upon detachment of pouch 20 from along tear line 110. As described above, closure 120 may comprise zipper 125, such as shown in FIGS. 5–10, slider 130, such as shown in FIGS. 11 and 12, or any other closure 120 known to those having ordinary skill in the art. FIGS. 5–8 show preferred embodiments of this invention wherein pouch 20 is removed along tear line 110. This removes the upper portion 25 from pouch 20 and permits sides 24, 26 to separate thereby exposing closure 120. Sides 24, 26 act as convenient hand holds for manipulating closure 120. FIGS. 9 and 10 show a preferred embodiment of this invention wherein pouch 20 is removed along tear line 110 but the sides of pouch 20 are not separated until a secondary tear line 115, discussed below, is severed. FIGS. 11 and 12 show a preferred embodiment of this invention wherein pouch 20 is removed along tear line 110 to expose slider 130 which, when opened, separates the sides of pouch 20.

Alternatively, the sides 24, 26 of pouch 20 may separated and pouch 20 may be opened along tear line 110 as a result of separation from package 10. According to this preferred embodiment of the invention, pouch 20 does not include a closure, resealable or otherwise, and contents of such pouch 20 are immediately accessible following detachment from multipack header 30. As a result, at least a part of top portion 25 of pouch 20 would typically remain attached to multipack header 30 following removal of pouch 20, depending upon relative location of tear line 110. FIG. 4 shows a partial package 10 wherein two pouches 20 have been removed from the left side of package 10, leaving top portion 25 connected to multipack header 30, and a third pouch 20 is partially removed along tear line 110. As described, following removal, the sides of pouch 20 are preferably separable either immediately, or following access via closure 120 and/or secondary tear line 115, as described below.

According to another preferred embodiment of this invention, each pouch 20 additionally includes secondary tear line 115 which preferably becomes accessible upon detachment of pouch 20 along tear line 110. Such secondary tear line 115 permits pouch 20 to be detached from package 10 and still retain a tamper evident seal and/or an additional tear line that retains the integrity of separated pouch 20 as if pouch 20 was purchased or obtained individually. Secondary tear line 115 can then be opened to expose either the contents of pouch 20 or closure 120 such as described above.

FIGS. 5, 6, 9 and 10 show two preferred embodiments of a secondary tear line. According to the embodiment shown in FIGS. 5 and 6, pouch 20 is removed along tear line 110 (the primary tear line) and, as a result, the sides of pouch 20 are separated thereby exposing closure 120. The consumer may then open closure 120 to expose and then open secondary tear line 115 thus insuring a tamper evident package following removal of pouch 20 from multipack header 35. Alternatively, FIGS. 9 and 10 show secondary tear line 115 positioned above closure 120 whereby following removal of pouch 20 from multipack header 35, secondary tear line 115 is opened to separate sides of pouch 20 providing access to closure 120.

According to one preferred embodiment of this invention, following removal of each pouch 20 from multipack header 30, top portion 25 of each pouch 20 remains attached to multipack header 30. Such an arrangement minimizes separate waste generated by removal of each pouch 20 from multipack header 30. As a result, following removal of each and every pouch 20 from package 10, n number of top portions 25 will still be adhered along multipack header 30, wherein n=number of pouches 20 within package 10.

As a result of the configurations described above, the unitized package 10 according to this invention is preferably a self-supporting package having adequate promotional area to display product and marketing information and further enable a manufacturer or distributor to bundle and unitize multiple packages of one product or multiple packages of different products into a single, easy-to-carry package. In addition, the unitized package 10 is configured in such a manner to permit the individual removal of pouches 20 without damaging the integrity of the removed pouch or the remaining pouches 20 within package 10. Finally, the unitized package according to this invention permits the individual pouches 20 to be separately removed from the multipack header 30 while still retaining a closure and/or tamper evident seal.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

We claim:

1. A unitized package comprising:

at least two pouches arranged in an array, each pouch comprising two flexible sides terminating at a seal across a top portion, the seal formed between inner walls of the two sides, each pouch containing an amount of product for consumer use or consumption;

a multipack header connecting the at least two pouches and adhered along the top portion of each pouch, wherein each pouch is removably attached along a primary tear line to disengage each pouch;

wherein each pouch further includes a closure, the closure accessible upon detachment of the pouch along the primary tear line; and a secondary tear line, the secondary tear line remaining integral with the pouch upon detachment of the pouch along the primary tear line.

2. The unitized package of claim 1 wherein the closure is one of a slider and a zipper.

3. The unitized package of claim 1 wherein the closure forms the seal between the inner walls of The two flexible sides across the top portion.

4. The unitized package of claim 1 wherein the top portion of each pouch remains attached to the multipack header following removal of the pouch from the unitized package.

5. The unitized package of claim 1 wherein the multipack header further comprises:

a gripping aperture positioned along a top portion of the multipack header; and two planar attachment areas extending from below the top portion of the multipack header in different planes from the top portion of the multipack header, wherein each planar attachment area is attached to at least one pouch.

6. The unitized package of claim 1 wherein the at least two pouches are heat sealed to the multipack header.

7. The unitized package of claim 1 wherein the at least two pouches are glued to the multipack header.

8. A unitized package comprising:

a flexible multipack header having at least two attachment areas;

a pouch having two generally parallel sides extending toward an upper end adhered to each attachment area and removable along a primary tear line, the pouch containing an amount of product for consumer use or consumption;

a closure positioned within the pouch that, is accessible following separation of the pouch from the multipack header; and wherein the pouch further comprises a secondary tear line, the secondary tear line accessible upon detachment of the pouch along the primary tear line.

9. The unitized package of claim 8 wherein an arrangement of the pouch adhered to each attachment area of the multipack header results in opposing pouches that lean against each other to form a self-supporting package.

10. The unitized package of claim 8 wherein the at least two attachment areas are mated immediately below a gripping aperture.

11. A unitized package comprising:

two or more pouches, each pouch comprising two flexible sides terminating at a seal across a top portion, the seal formed between inner walls of the two sides; and a multipack header positioned between the two or more pouches, the top portion of each pouch adhered to the multipack header;

a primary tear line positioned between the top portion of each pouch and a remaining portion of the pouch so that each pouch is separately removable from the multipack header along the primary tear line;

a secondary tear line, the secondary tear line accessible upon detachment of the pouch along the primary tear line; and wherein each pouch further comprises a closure, the closure accessible upon detachment of the pouch along the primary tear line.

12. The unitized package of claim 11 wherein the closure is one of a slider and a zipper.

* * * * *